United States Patent [19]

Owings

[11] 4,346,594

[45] Aug. 31, 1982

[54] METHOD FOR LOCATING THE DEPTH OF A DRILL STRING WASHOUT OR LOST CIRCULATION ZONE

[76] Inventor: Allen J. Owings, 710 Saint Ives, Houston, Tex. 77079

[21] Appl. No.: 206,572

[22] Filed: Nov. 14, 1980

[51] Int. Cl.[3] ..... E21B 47/10

[52] U.S. Cl. ..... 73/155

[58] Field of Search ..... 73/155; 175/48

[56] References Cited

U.S. PATENT DOCUMENTS

| | | | |
|---|---|---|---|
| 2,290,408 | 7/1942 | Crites | 73/155 |
| 2,528,956 | 11/1950 | Hayward | 73/151 X |
| 4,297,880 | 11/1981 | Berger | 73/155 |

*Primary Examiner*—Jerry W. Myracle

*Attorney, Agent, or Firm*—Guy E. Matthews

[57] ABSTRACT

For use in an oil well drilling system, methods are disclosed to determine the depth of drill string washouts and the depth of leach zones that cause lost circulation. The methods are based primarily on the circulating pressure of the drilling fluid at the surface within the standpipe.

6 Claims, 4 Drawing Figures

METHOD FOR LOCATING THE DEPTH OF A DRILL STRING WASHOUT OR LOST CIRCULATION ZONE

FIELD OF THE INVENTION

The instant invention relates generally to the drilling of wells by the use of rotary drill strings and the circulation of drilling fluids such as mud, water, or oil. More particularly, the instant invention relates to the determination of the depth within a well bore that circulation of drilling fluid deviates from its intended flow path when such deviation occurs due to washouts or leach zones.

BACKGROUND OF THE INVENTION

The circulation of drilling fluid for the drilling of a deep well provides several benefits some of which are lubrication of the bit, cooling of the bit, removal of cuttings from the borehole, and retention of formation pressures by the weight of the drilling fluid. The drilling fluid is normally pumped by means of conventional surface equipment downwardly through the drill pipe, continuing downwardly through the drill collars, through small holes in the drill bit, up the annulus between the borehole and the drill collars, and thence up the annulus between the borehole and the drill pipe to the surface for reconditioning so as to be recirculated. The route within the well shall be called the flow path herein. The hydrostatic pressure caused by the drilling fluid increases as depth increases, and since the hydrostatic pressure within the drill string is normally equal to the hydrostatic pressure within the annulus at the same depth, the instant invention is not concerned with hydrostatic pressure. However, the present invention is most concerned with pressure on the drilling fluid caused by conventional pumps mounted at the surface. For purposes herein, the pressure imposed by the pumps on the drilling fluid shall be termed circulating pressure herein. Conventionally, fluid enters the drill string under sufficient pump pressure to cause it to circulate along the flow path at a desired flow rate, progressively losing some of the circulating pressure along the flow path due to friction losses within the drilling string across the drill bit, and up the annulus until it becomes zero when it returns to the surface.

On many occasions, threaded joints of the drill string have not sealed against the drilling fluid, allowing a short circuit of the flow path to form through the wall of the drill string and to at least partially bypass the lower drill string, the drill bit, and the lower annulus. Such a bypass condition is generally termed a "washout". If a washout is not located early, it can defeat the purposes of the drilling fluid as stated above and thereby risk stuck pipe, early bit failure, dangerous fishing jobs, loss of the well, a blowout, pollution, loss of energy, extreme costs, and more. The instant invention provides a method for the early detection and location of a washout so as to allow for repair with minimal problems.

Another problem encountered often is the loss of drilling fluid from the borehole into a leach zone, such a problem being generally called "lost circulation". Lost circulation can risk the same results as given above for a washout. The instant invention provides a method for the early location of a zone of lost circulation so as to allow for remedial action with minimal problems. A zone of lost circulation shall herein be called a leach zone. Crites U.S. Pat. No. 2,290,408 discloses a method of detecting and locating leach zones by recording and comparing the difference in the input and output volumes of drilling fluid to the depth of the borehole. If while drilling at a given depth the input volume of drilling fluid substantially exceeded the output volume, it was assumed that the formation at that depth was a leach zone. As well known to those skilled in the art however, formations further up the borehole may begin to receive drilling fluid due to such factors as a change in drilling fluid characteristics, higher pump pressures, or the loss of mud cake on the borehole wall. Nonetheless, Crites input output volume comparison to be of interest for the detection of but not for the location of leach zones. Such interest is evidenced by the recent article by Mans, Peters and Meador of Exxon Production Research Co., the article being published in the *Oil & Gas Journal* dated Aug. 20, 1979.

Hayward U.S. Pat. No. 2,528,956 discloses a method of locating washouts by injecting an "indicator fluid" and calculating the depth of the washout as follows: divide the volume of fluid pumped into the drill string between the time of injecting the indicator fluid and the time of the return of some of the indicator fluid to the top of the annulus by twice the average cross-sectional area of the flow path to and from the washout. To use this method accurately, the operator must first caliper the borehole or make an accurate assumption of the diameter and he must already know approximately where the washout is if the borehole diameter varies. Also, if a small washout is to be detected, most if not all the inductor fluid will continue down the drill string, bypassing the washout and thereby render detection at the surface of the first returns of the indicator fluid most difficult indeed.

It is a primary feature of this invention to provide a method to determine the depth of a drill string washout quickly and without interrupting drilling operations.

It is another feature of this invention to provide a method to determine the depth of a leach zone quickly and without interrupting drilling operations.

It is still another feature of this invention to provide methods for locating washouts and leach zones that may be practiced automatically and continuously by means of a computer.

It is another feature of this invention to allow for early remedial action so as to correct for washouts or leach zones.

It is another feature of this invention to reduce the probability of a blowout.

It is another feature of this invention to reduce the probability of environmental pollution.

It is also a feature of this invention to reduce the waste of energy while drilling a well.

It is still another feature of this invention to determine whether a sudden reduction in circulating pressure during drilling is caused by a washout, a reduction in pump efficiency, or lost circulation to a leach zone.

It is also a feature of this invention to reduce the cost of drilling a well and thereby to reduce the cost of energy.

SUMMARY OF THE INVENTION

The instant invention comprises a method to determine the depth of a washout and a method to determine the depth of a leach zone quickly and without interrupting drilling operations.

For a given set of well conditions, a graph of normal circulating pressure verses the depth of points along the flow path within the well is determined. While drilling the well the actual circulating surface pressure is monitored, the actual output volume rate of drilling fluid is monitored, and a normal circulating surface pressure is determined. A substantial drop of actual circulating pressure at the surface below normal indicates a washout if drilling fluid returns continue, lost circulation to a leach zone if drilling fluid returns stop.

The principle involved in determining the depth of a leach zone is that whenever circulation is lost there will be a corresponding loss in circulating pressure. This is due to the fact that above the leach zone there will be no annular flow and consequently no annular pressure loss. The deeper the leach zone the greater the magnitude of the circulating pressure loss. FIG. 2 is a graphical illustration of normal pressure losses in a drilling mud system. FIG. 3 illustrates the effect a leach zone has on the circulating pressure. The reduction in annular pressure loss is reflected by a corresponding reduction in circulating pressure as measured at the surface. This reduction in circulating pressure can be defined mathematically by:

EQN.1 dPc=(dPdpa)(D.), if the circulating pressure loss is less than the calculated pressure loss in the annulus across the drill pipe and by:

EQN.2 dPc=(dPdpa)(Ldp)+(dPdca)(D.-Ldp), if the circulating pressure loss is greater than the calculated pressure loss across the drill pipe.

where:

dPc=Circulating pressure loss dPdpa=Pressure loss per ft. across drill pipe in annulus D.=depth of leach zone, ft.

dPdca=pressure loss per ft. across drill collars in annulus

Ldp=length of drill pipe, ft.

Ldc=length of drill collars, ft.

The principle involved in determining the depth of a washout is that the drilling fluid is partially "short-circuited" at the washout. In other words, part of the drilling fluid by-passes the drilling string components below the washout and immediately enters the annulus. As a result, the rate of flow inside the drill string below the washout is reduced, thereby causing a reduction in friction pressure losses inside the drilling string. FIG. 4 illustrates the effect that this reduced pressure loss has, by a corresponding loss in circulating pressure measured at the surface.

To mathematically define the pressure losses after a washout occurs, the following equation can be written: (Eqn. 3)

$$Pc_2 = (dP_1\,dp)(D_2) + P_2dp(Ldp - D_2) + (dP_2dc)$$

$$(Ldc) + dp_2b + (dP_2dca)(Loc) + (dP_2dpa)$$

$$(Ldp - D_2) + (dP_1dpa)(D_2)$$

where:

$Pc_2$=Circulating pressure after washout $dP_1dp$=pressure loss per ft. inside drill pipe above washout $D_2$=depth of washout, ft.

$dP_2dp$=pressure loss per ft. inside drill pipe below washout dp=length of drill pipe, ft.

$P_2dc$=pressure loss per ft. inside drill collars below washout $dP_2b$=pressure loss across bit below washout $dP_2dca$=pressure loss per ft. in annulus across drill collars, below washout Ldc=length of drill collars, ft.

$dP_2Dpa$=pressure loss per ft. in annulus across drill pipe, below washout $dP_1dpa$=pressure loss per ft. in annulus across drill pipe, above washout All pressure losses designated by dP. can be calculated and the lengths of the drill pipe, drill collars, and $Pc_2$ are known. To determine the pressure losses designated by $dP_2$ requires the determination of the rate of flow below the washout, ($Q_2$). Once this rate is determined all other parameters in Eqn. 1 become known except $D_2$, which can then be calculated.

To accurately determine $Q_2$ requires either direct measurement by instrument, or by calculation after measuring a direct relationship of $Q_2$, such as $dP_2B$, the pressure loss across the bit. Estimates may be made by comparing previous normal circulating pressures at reduced flow rates with the circulating pressures after the washout occurs.

The determine whether a reduction in circulating pressure is caused by (a) lost circulation, (b) a washout, or (c) a pump malfunction it is necessary to measure the following variables.

(1) circulating pressure (2) flow rate of mud returns (3) pump discharge flow rate After a loss in circulating pressure is observed, the mud return flow rate and pump discharge rate are compared to determine the problem. The pump should be adjusted to the same speed as before the pressure loss.

Wash-out: No change is discharge or return flow rates

Pump Malfunction: decrease in both discharge and return flow rates

Lost Circulation: decrease in return flow rate; no change in discharge flow rate By quickly determining the problem appropriate remedial action can be initiated. There would be no need to pull the drill string out of the hole if a pump malfunction were detected. On the other hand, the drill pipe would have to be retrieved in order to repair a washout.

Although the term graph is used to disclose the invention, it should be understood that the invention may be practiced mathematically or automatically by computer as well as geometrically graphing the values of interest.

DESCRIPTION OF THE PREFERRED EMBODIMENT

Figure 1:
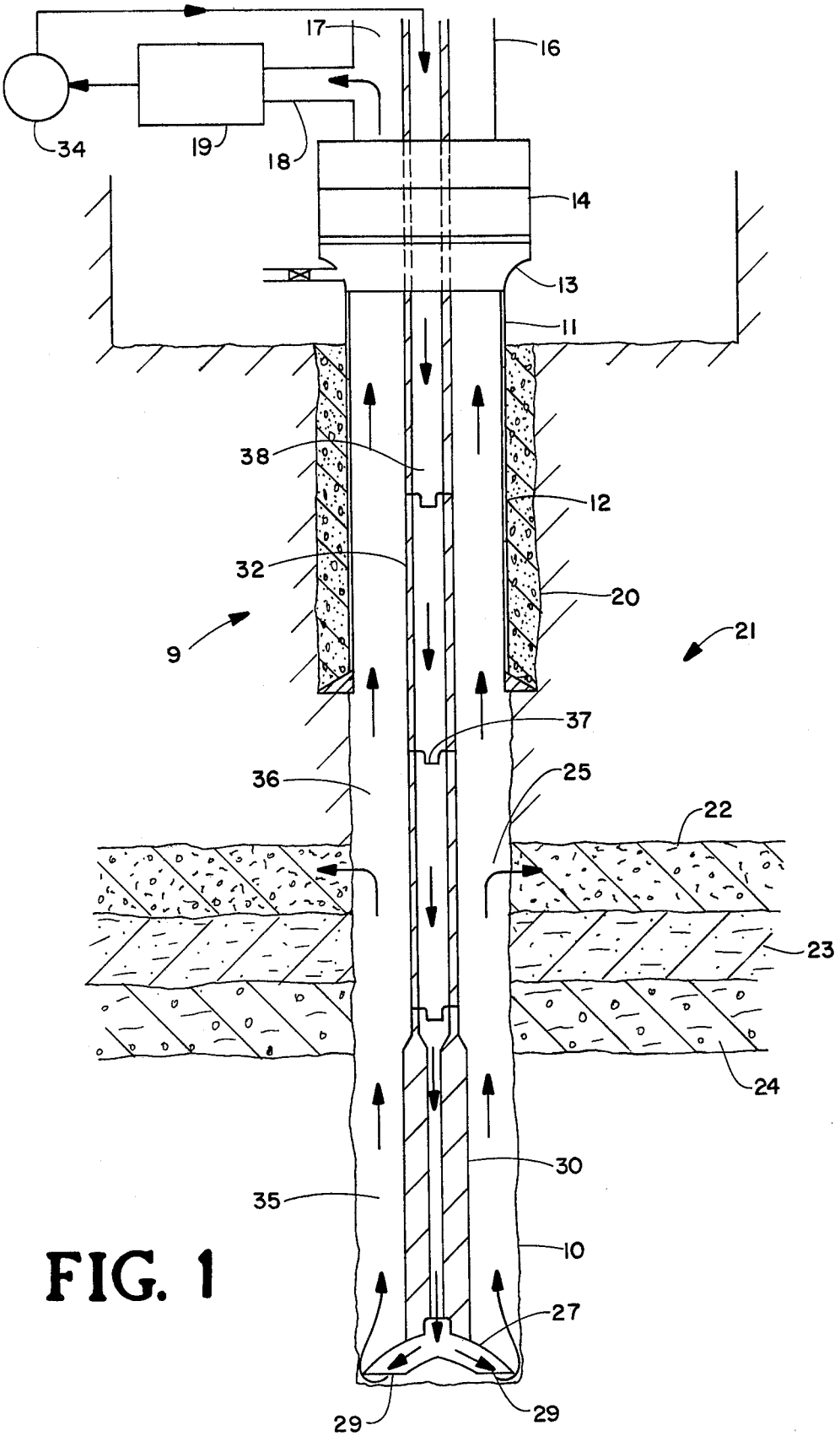
FIG. 1 is a fragmentary section of a schematic of a well.

FIG. 1 depicts a well shown generally at 9 having borehole 10 surrounding surface casing 11 which is anchored by casing cement 12 to the earth as at 20. Drilling head 13 is mounted with and above casing 11; blowout preventer 14 is mounted with and above drilling head 13. Bell nipple 16 is mounted with and above blowout preventer 14 so as to retain drilling fluid 17 sufficiently so as to cause the drilling fluid to flow into conduit 18, conduit 18 being interconnected with between the bell nipple and mud tanks 19 for reconditioning in a conventional manner. Borehole 10 penetrates earth formations depicted as at 21, 22, 23, and 24, formation 22 representing a leach zone that may receive drilling fluid 17 from borehole 10 as indicated by arrow 25. Drill bit 27 having outlet jet 29, is sealingly attached to drill collar 30 by means of conventional threads.

Although only one drill collar is shown, any suitable number may be used. Any suitable number of drill pipe joints as at 32 may be interconnected with the uppermost drill collar, drill pipe 32, drill collars 30, and bit 27 comprising the drill string. Drilling fluid 17 is pressurized by conventional surface mounted mud pumps 34 and conveyed through suitable means into the drill stem to exit through jet 29 as is well known in the art.

The drill string is rotated in the conventional manner so as to cause bit 27 to drill deeper into the earth. After drilling fluid 17 exits jet 29, it normally flows up the annulus formed between borehole 10 and drill collars 30 as at 35 and thence up the annulus formed between borehole 11 and drill pipe 32 as at 36 and thence upwardly within casing 11 to exit bell nipple 16 through outlet 18. Flow path 38 comprises the interior of the drill string, jet 29, annulae 35, 36, and the interior of casing 11. A connection as at 37 within the drill string can occasionally develop a leak allowing a portion of the drilling fluid within the drill string to flow through connection 37 and into annulus 36 to thereby bypass the portion of the drill string below connection 37 and to defeat the purposes of drilling fluid 17 as previously described and as is well known in the art. This bypass condition is termed a washout. Since the surface of drilling fluid 17 is substantially at the input level of the drilling fluid, the hydrostatic pressure due to weight of the drilling fluid is effectively balanced between the interior of the drill string and the annulus at any given level. Therefore, this invention deals primarily with the circulating pressure along the flow path which is at a maximum at the top of the drill string and which diminishes as it flows along the flow path to zero upon reaching the surface.

Figure 2:
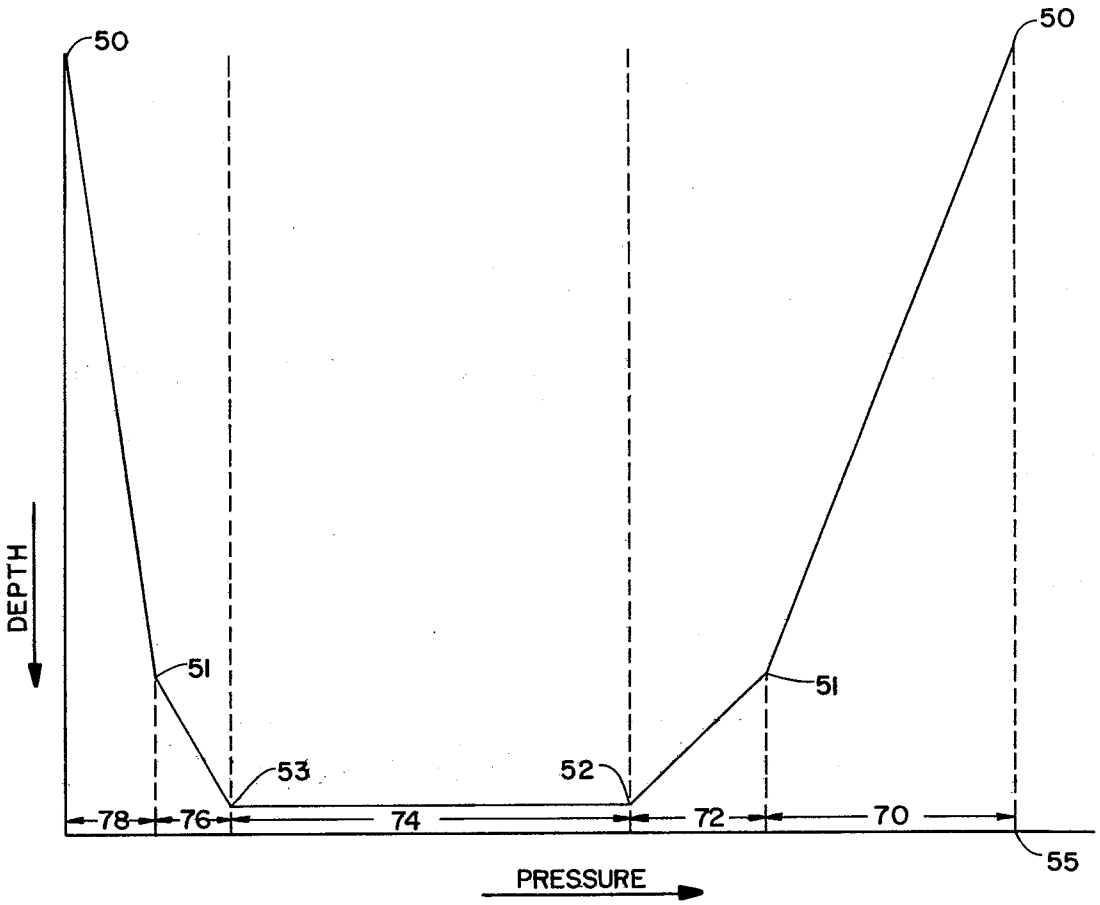
FIG. 2 is a graph illustrating the distribution of loses inside and outside the drill string for normal operation, the circulating pressure scale being horizontal and the depth from surface scale being vertical.

The line of FIG. 2 shows the normal circulating pressure continuously decreasing as the fluid flows from the top of the drill pipe as at surface 50 through the drill pipe, to depth 51, through the drill collars, to bit depth 52, through drill bit jet 29 from 52 to 53, through annulus 35 back to depth 51 and through annulus 36 back to the surface as at 50. The pump pressure as at 55 equals the pressure loss 70 inside of the drill pipe, plus pressure loss 72 inside of the drill collars, plus the pressure loss 74 across the bit, plus pressure loss 76 in the annulus around the drill collars, plus pressure loss 78 in the annulus around the drill pipe.

OPERATION OF THE INVENTION

Figure 3:
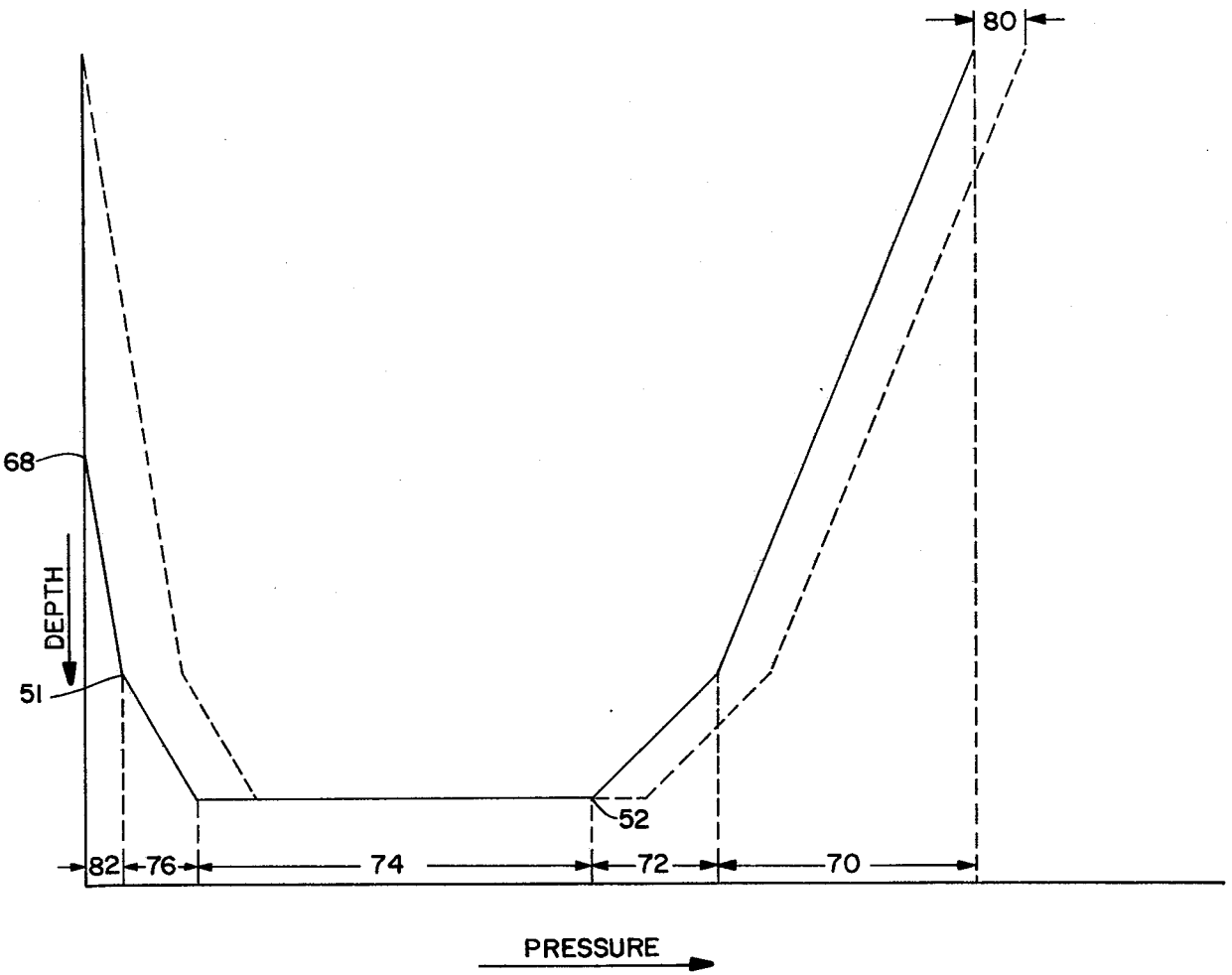
FIG. 3 is a graph illustrating the effect a leach zone has on the circulating pressure.

The dotted line of FIG. 3 coincides with the solid line of FIG. 2, both depicting the normal circulating pressure along the flowpath for bit depth 52 when no malfunction exists. The solid line of FIG. 3 depicts the circulating pressure along the flow path when at bit depth 52 when lost circulation is caused by a leach zone as at depth 68. For a constant mud flow rate, and pump pressure drop 80, the solid line may be drawn by scaling pressure losses 70–76 at their respective depths. The drill pipe annulus pressure loss is thereby reduced to the value as shown at 82 and depth 68 may be determined by drawing the solid line from depth 51 upwardly and parallel to the dotted line, the point of intersection with the zero pressure scale being the depth 68 of the leach zone. Depth 68 may also be determined mathematically as given in the summary above.

Figure 4:
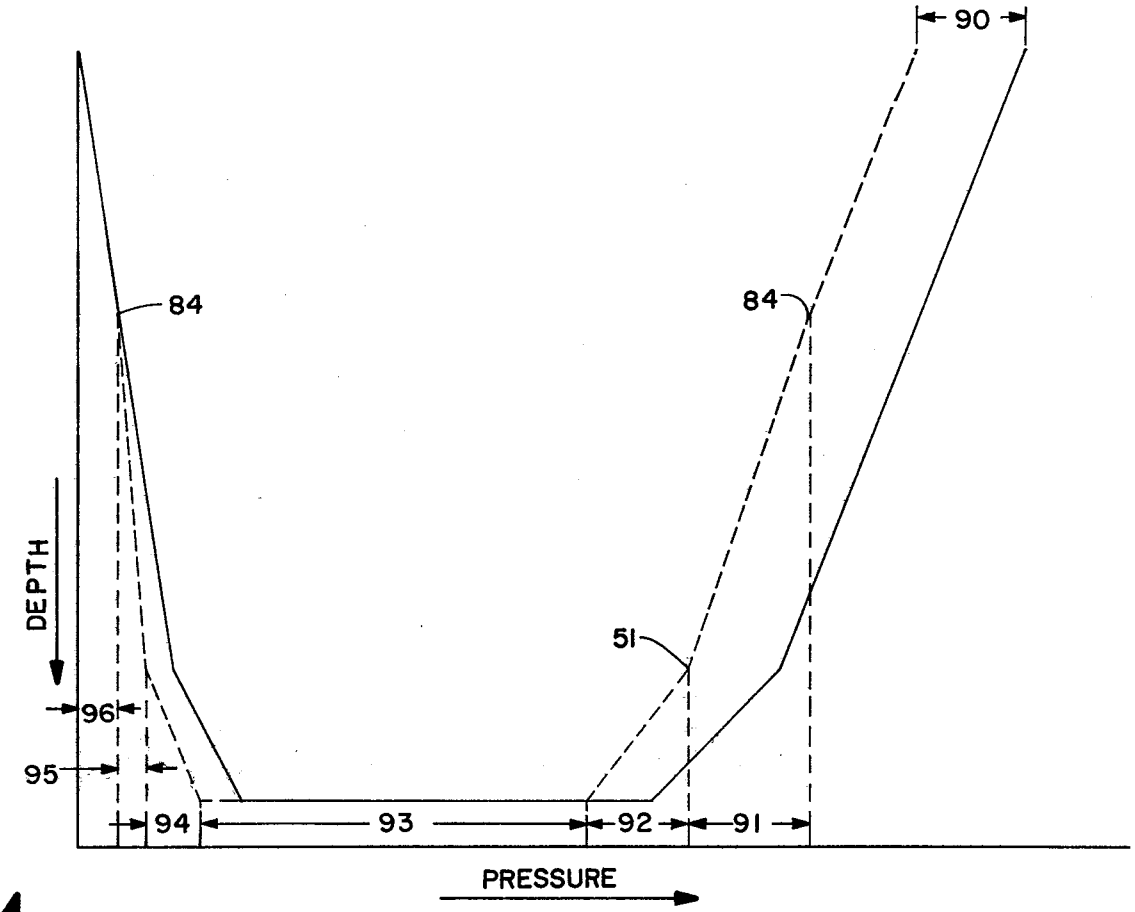
FIG. 4 is a graph illustrating the effect a washout has on the circulating pressure.

The solid line of FIG. 4 coincides with the line of FIG. 2, both depicting the normal circulating pressure along the flow path for bit depth 52 when no malfunction exists. The dotted line of FIG. 4 depicts the circulating pressure along the flow path for bit depth 52 when a drill pipe washout occurs as at depth 84. For this washout condition, the reduced pump pressure equals the pressure loss 90 inside of the drill pipe above the washout at depth 84, plus pressure loss 91 due to the reduced flow volume not leaking through the drill string wall but continuing to depth 51, plus pressure loss 92 of the reduced flow volume flowing through the drill collars, plus pressure loss 93 of the reduced volume flowing through bit jet 29, plus pressure loss 94 of the reduced volume flowing up the annulus around the drill collars, plus pressure loss 95 flowing up the annulus around the drill pipe to depth 84, plus pressure loss 96 of this full volume flowing up the annulus around the drill pipe from depth 84 to the surface. Therefore, as disclosed in the summary of the invention, it is possible to calculate depth 68 of the leach zone of FIG. 3 and to calculate depth 84 of the drill string washout of FIG. 4. Although practice of the instant invention has been described as geometrically done, it is within the scope and spirit of the instant invention to utilize purely mathematical techniques, slide rules, tables, computers, or any combination comprising any one of the above.

It is therefore apparent that the present invention is one well adapted to attain all of the objects and advantages hereinabove set forth, together with other advantages which will become obvious and inherent from a description of the method and apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

The invention having been described, what is claimed is:

1. In an oil well drilling operation, a method of determining the depth of a drill string washout, said method comprising determining that drilling fluid return volume from the well substantially equals the drilling fluid input volume to the well; determining that a substantial drop in surface circulating pressure has occurred; for given well drilling conditions, determining a first graph of the normal circulating pressures of the drilling fluid versus the depth of points along the flow path within the well; determining for said well drilling conditions a second graph of the actual circulating pressure of the drilling fluid versus the depth of points along the flow path within the well; superimposing one graph over the other graph so as to cause lines representing circulating pressures in the drill string to intersect at the same depth as do the lines representing circulating pressures in the annulus, the depth of duel intersection being the depth of the washout.

2. The method of claim 1 wherein the first and second graphs are formed geometrically.

3. The method of claim 1 wherein the first and second graphs are formed mathematically.

4. In an oil well drilling system, a method of determining the depth of a leach zone, said method comprising determining that drilling fluid return volume from the well is substantially nil; determining a substantial drop in the surface circulating pressure; determining for given well drilling conditions a graph of the normal differential pressures of the drilling fluid verses the depth of points along the flow path within the well; determining the difference of pressure between the normal and actual circulating pressures at the surface; determining the depth on the graph corresponding to a circulating annulus pressure that is numerically equal to the difference in the normal and actual surface pressure, that depth being the depth of the leach zone.

5. The method of claim 4 wherein the graph is formed geometrically.

6. The method of claim 4 wherein the graph is formed mathematically.

* * * * *